US006613268B2

(12) United States Patent
Haynes et al.

(10) Patent No.: US 6,613,268 B2
(45) Date of Patent: Sep. 2, 2003

(54) METHOD OF INCREASING THE MELTBLOWN JET THERMAL CORE LENGTH VIA HOT AIR ENTRAINMENT

(75) Inventors: Bryan David Haynes, Cumming, GA (US); Jeffrey Lawrence McManus, Canton, GA (US); Justin Max Duellman, Little Rock, AR (US); Darryl Franklin Clark, Alpharetta, GA (US); Roger Bradshaw Quincy, III, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 175 days.

(21) Appl. No.: 09/746,857

(22) Filed: Dec. 21, 2000

(65) Prior Publication Data

US 2002/0117782 A1 Aug. 29, 2002

(51) Int. Cl.[7] ..... D01D 5/084; D01D 5/098; D01D 5/14; D01F 1/02; D04H 3/02

(52) U.S. Cl. ..... 264/555; 264/103; 264/210.6; 264/210.8; 264/211.17

(58) Field of Search ..... 264/103, 210.6, 264/210.8, 211.17, 555

(56) References Cited

U.S. PATENT DOCUMENTS

| | | | |
|---|---|---|---|
| 3,849,241 | A | 11/1974 | Butin et al. |
| 3,973,068 | A | 8/1976 | Weber |
| 4,070,173 | A | 1/1978 | Levecque et al. |
| 4,070,218 | A | 1/1978 | Weber |
| 4,102,662 | A | 7/1978 | Levecque et al. |
| 4,112,159 | A | 9/1978 | Pall |
| 4,118,213 | A | 10/1978 | Levecque et al. |
| 4,137,059 | A | 1/1979 | Levecque et al. |
| 4,472,329 | A | 9/1984 | Muschelknautz et al. |
| 4,526,733 | A | 7/1985 | Lau |
| 4,578,414 | A | 3/1986 | Sawyer et al. |
| 4,622,259 | A | 11/1986 | McAmish et al. |
| 4,827,999 | A | 5/1989 | Yabuki et al. |
| 4,855,360 | A | 8/1989 | Duchesne et al. |
| 4,863,983 | A | 9/1989 | Johnson et al. |
| 4,889,546 | A | 12/1989 | Denniston |
| 4,923,914 | A | 5/1990 | Nohr et al. |
| 5,025,052 | A | 6/1991 | Crater et al. |
| 5,075,068 | A | 12/1991 | Milligan et al. |
| 5,080,569 | A | 1/1992 | Gubernick et al. |
| 5,098,636 | A | 3/1992 | Balk |
| 5,145,727 | A | 9/1992 | Potts et al. |
| 5,160,746 | A | 11/1992 | Dodge, II et al. |
| 5,196,207 | A | 3/1993 | Koenig |
| 5,405,559 | A | 4/1995 | Shambaugh |
| 5,459,188 | A | 10/1995 | Sargent et al. |
| 5,607,701 | A | 3/1997 | Allen et al. |
| 5,696,191 | A | 12/1997 | Nohr et al. |
| 5,711,970 | A | 1/1998 | Lau et al. |
| 5,798,402 | A | 8/1998 | Fitzgerald et al. |
| 6,001,303 | A | 12/1999 | Haynes et al. |
| 6,247,911 | B1 | 6/2001 | Milligan |
| 2001/0026815 | A1 | 10/2001 | Suetomi |

FOREIGN PATENT DOCUMENTS

| | | |
|---|---|---|
| EP | 0 474 423 A2 | 3/1992 |
| WO | WO 99/32692 A1 | 7/1999 |

*Primary Examiner*—Leo B. Tentoni
(74) *Attorney, Agent, or Firm*—Pauley Peterson Kinne & Erickson

(57) ABSTRACT

A method for producing super fine meltblown fibers increases the length of the meltblown jet thermal core to increase the dwell time of the extruded thermoplastic polymer within the jet thermal core. Through use of the method it is practical to use low viscosity resins and further to provide meltblown nonwovens with superior barrier properties to the passage of fluids and particularly gases. The method further provides a useful means for blooming internal additives to the surface of the fibers.

21 Claims, 4 Drawing Sheets

METHOD OF INCREASING THE MELTBLOWN JET THERMAL CORE LENGTH VIA HOT AIR ENTRAINMENT

FIELD OF THE INVENTION

The present invention relates to an apparatus and process for forming meltblown fibers. More specifically, the present invention relates to an apparatus and process for forming meltblown fibers utilizing an extended jet thermal core produced by entraining hot air at the point of jet thermal core formation.

BACKGROUND OF THE INVENTION

Meltblown fibers are fibers formed by extruding a molten thermoplastic material through a plurality of fine, usually circular, die capillaries as molten threads or filaments into converging, usually hot and high velocity, gas, e.g. air, streams to attenuate the filaments of molten thermoplastic material and form fibers. During the meltblowing process, the diameter of the molten filaments are reduced by the drawing air to a desired size. Thereafter, the meltblown fibers are carried by the high velocity gas stream and are deposited on a collecting surface to form a web of randomly disbursed meltblown fibers. Such a process is disclosed, for example, in U.S. Pat. Nos. 3,849,241 to Buntin et al., 4,526,733 to Lau, and 5,160,746 to Dodge, II et al., all of which are hereby incorporated herein by this reference. Meltblown fibers may be continuous or discontinuous and are generally smaller than ten microns in average diameter.

In a conventional meltblowing process, molten polymer is provided to a die that is disposed between a pair of air plates that form a primary air nozzle. Standard meltblown equipment includes a die tip with a single row of capillaries along a knife edge. Typical die tips have approximately 30 capillary exit holes per linear inch of die width. The die tip is typically a 60° wedge-shaped block converging at the knife edge at the point where the capillaries are located. The air plates in many known meltblowing nozzles are mounted in a recessed configuration such that the tip of the die is set back from the primary air nozzle. However, air plates in some nozzles are mounted in a flush configuration where the air plate ends are in the same horizontal plane as the die tip; in other nozzles the die tip is in a protruding or "stick-out" configuration so that the tip of the die extends past the ends of the air plates. Moreover, as disclosed in U.S. Pat. No. 5,160,746 to Dodge II et al., more than one air flow stream can be provided for use in the nozzle.

In some known configurations of meltblowing nozzles, hot air is provided through the primary air nozzle formed on each side of the die tip. The hot air heats the die and thus prevents the die from freezing as the molten polymer exits and cools. In this way the die is prevented from becoming clogged with solidifying polymer. The hot air also draws, or attenuates, the melt into fibers. Other schemes for preventing freezing of the die, such as that detailed in U.S. Pat. No. 5,196,207 to Koenig, using heated gas to maintain polymer temperature in the reservoir, are also known. Secondary, or quenching, air at temperatures above ambient is known to be provided through the die head, as in U.S. Pat. No. 6,001,303 to Haynes et al.

Primary hot air flow rates typically range from about 20 to 24 standard cubic feet per minute per inch of die width (SCFM/in).

Primary air pressure typically ranges from 5 to 10 pounds per square inch gauge (psig) at a point in the die head just prior to exit. Primary air temperature typically ranges from 450° to 600° Fahrenheit (F), but temperatures of 750° F. are not uncommon. The particular temperature of the primary hot air flow will depend on the particular polymer being drawn as well as other characteristics desired in the meltblown web.

Expressed in terms of the amount of polymer material flowing per inch of the die per unit of time, polymer throughput is typically 0.5 to 1.25 grams per hole per minute (ghm). Thus, for a die having 30 holes per inch, polymer throughput is typically about 2 to 5 lbs/inch/hour (PIH).

Moreover, in order to form meltblown fibers from an input of about five pounds per inch per hour of the polymer melt, about one hundred pounds per inch per hour of hot air is required to draw or attenuate the melt into discrete fibers. This drawing air must be heated to a temperature on the order of 400–600° F. in order to maintain proper heat to the die tip.

Because such high temperatures must be used, a substantial amount of heat is typically removed from the fibers in order to quench, or solidify, the fibers leaving the die orifice. Cold gases, such as air, have been used to accelerate cooling and solidification of the meltblown fibers. In particular, in U.S. Pat. No. 5,075,068 to Milligan et al. and U.S. Pat. No. 5,080,569 to Gubernick et al., secondary air flowing in a cross-flow perpendicular, or 90°, direction relative to the direction of fiber elongation, has been used to quench meltblown fibers and produce smaller diameter fibers. In addition, U.S. Pat. No. 5,607,701 to Allen et al., uses a cooler pressurized quench air that fills chamber 71 and results in faster cooling and solidification of the fibers. In U.S. Pat. No. 4,112,159 to Pall, a cold air flow is used to attenuate the fibers when it is desired to decrease the attenuation of the fibers.

Through the control of air and die tip temperatures, air pressure, and polymer feed rate, the diameter of the fiber formed during the meltblown process may be regulated. For example, typical meltblown polypropylene fibers have a diameter of 3 to 4 microns.

After cooling, the fibers are collected to form a nonwoven web. In particular, the fibers are collected on a forming web that comprises a moving mesh screen or belt located below the die tip. In order to provide enough space beneath the die tip for fiber forming, attenuation and cooling, forming distances of at least about 8 to 12 inches between the polymer die tip and the top of the mesh screen are required in the typical meltblowing process.

However, forming distances as low as 4 inches are described in U.S. Pat. No. 4,526,733 to Lau (hereafter the Lau patent). As described in Example 3 of the Lau patent, the shorter forming distances are achieved with attenuating air flows of at least 100° F. cooler than the temperature of the molten polymer. For example, Lau discloses the use of attenuating air at 150° F. for polypropylene melt at a temperature of 511° F. to allow a forming distance between die tip and forming belt of 4 inches. The Lau patent incorporates passive air gaps 36 (shown in FIG. 4 of Lau) to insulate the die tip.

Past efforts have largely focused on improved quenching in these short distances, where it can take as little as 1.3 ms for the meltblown extrudate to travel from the die to the collecting wire. The present invention approaches the problem of meltblown fiber formation from the opposite direction by seeking to increase the dwell time of the extrudate within the hot jet thermal core in order to further attenuate the fibers and also to allow the fibers to be formed from lower viscosity resins than were previously practical.

SUMMARY OF THE INVENTION

The present invention provides a method for producing super fine meltblown fibers by increasing the length of the meltblown jet thermal core to increase the dwell time of the extruded thermoplastic polymer within the jet thermal core. Through use of the method it is practical to use low viscosity resins and further to provide the resultant meltblown nonwovens with superior barrier properties to the passage of fluids and particularly gases.

The apparatus for practicing the method is both economical and easily retrofitted to existing meltblown fiber apparatus.

In essence, an entrainment duct or heat source is placed at the point of formation of the jet thermal core (hereinafter sometimes referred to synonymously as "jet") and used to shroud the jet area from cold air and entrain warm air into the jet thereby lengthening it. Thus, the jet will provide higher temperatures over a longer distance and time for the extruded fibers and maintain a low melt viscosity during the fibers' passage through the fiber attenuation zone.

Through the use of the lengthened jet, lower viscosity resins than heretofore practical may be used to form the fibers. Further, the resultant web of fibers made according to the present invention will have superior barrier properties to the passage of air and other fluids making a useful fabric for either barrier or filtration applications. Also, due to increased jet length, polymer additives may tend to bloom towards the surface of the fibers. Practical applications of fabric made according to the present invention may include barrier fabrics such as surgical gowns or the like and filtration materials.

BRIEF DESCRIPTION OF THE DRAWINGS

These and other objects and features of this invention will be better understood from the following detailed description taken in conjunction with the drawings wherein.

DEFINITIONS

"Attenuation zone", as may be used herein synonomously with "effective jet core length", is the position (z/w scale) on the centerline of the jet where the temperature is 90% of the exit, or origin, temperature of the jet. This definition is offered as an aid to understanding the present invention and is not meant to imply that no further attenuation of the fibers takes place beyond this point in practicing the present invention.

"Melt flow rate" (MFR) is a measure of the viscosity of a polymer. The MFR is expressed as the weight of material which flows from a capillary of known dimensions under a specified load or shear rate for a measured period of time and is measured in grams/10 minutes at a set temperature and load according to, for example, ASTM test 1238-90b.

"Hydrohead" is a measure of the liquid barrier properties of a fabric. The hydrohead test determines the height of water (in centimeters) which the fabric will support before a predetermined amount of liquid passes through. A fabric with a higher hydrohead reading indicates it has a greater barrier to liquid penetration than a fabric with a lower hydrohead. The hydrohead test can be performed according to Federal Test Standard 191A, Method 5514, or with slight variations of this test as set forth below.

"Super fine meltblown fibers" generally refers to meltblown fibers of less than 2 micron diameter.

"Low viscosity resins" refers to a resin with an MFR of under 400 for a resin without additives.

DETAILED DESCRIPTION OF THE INVENTION

Figure 1:
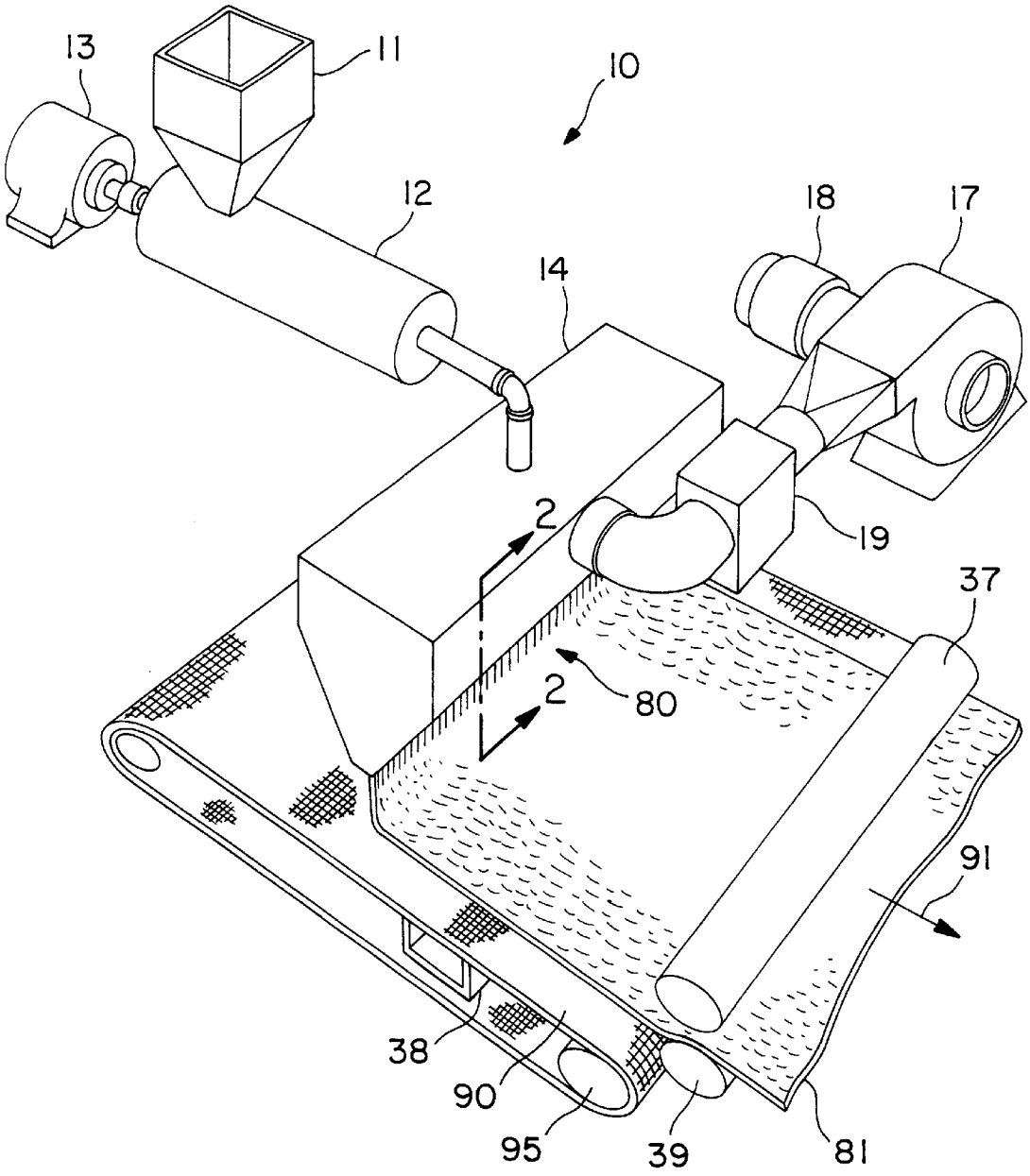
FIG. 1 is a schematic representation of a perspective view of a known meltblown fiber forming apparatus suitable for use in conjunction with the present invention.

An embodiment of a known apparatus for forming a meltblown web is shown schematically in FIG. 1 and is represented generally by the numeral 10. As is conventional, the apparatus includes a reservoir 11 for supplying a quantity of fiber-forming thermoplastic polymer resin to an extruder 12 driven by a motor 13.

The fiber-forming polymer is provided to a die apparatus 14 and heated therein by conventional electric heaters (not visible in the view shown). A primary flow of heating fluid, preferably air, is provided to die 14 by a blower 17, which is powered by a motor 18. An auxiliary heater 19 may be provided to bring the primary flow of heating air to higher temperatures on the order of the melting temperature of the polymer.

At the discharge opening of die 14, quenched fibers 80 are formed and collected on a continuous foramenous screen or belt 90 into a nonwoven web 81 as belt 90 moves in the direction indicated by the arrow designated by the numeral 91. The fiber forming distance is the distance between the upper surface of collecting web 90 and the plane of the discharge opening of die 14.

As shown in FIG. 1, collection of fibers 80 on belt 90 may be aided by a suction box 38. The formed nonwoven web 81 may be compacted or otherwise bonded by rolls 37, 39. Belt 90 may be rotated via a driven roll 95 for example.

Figure 2:
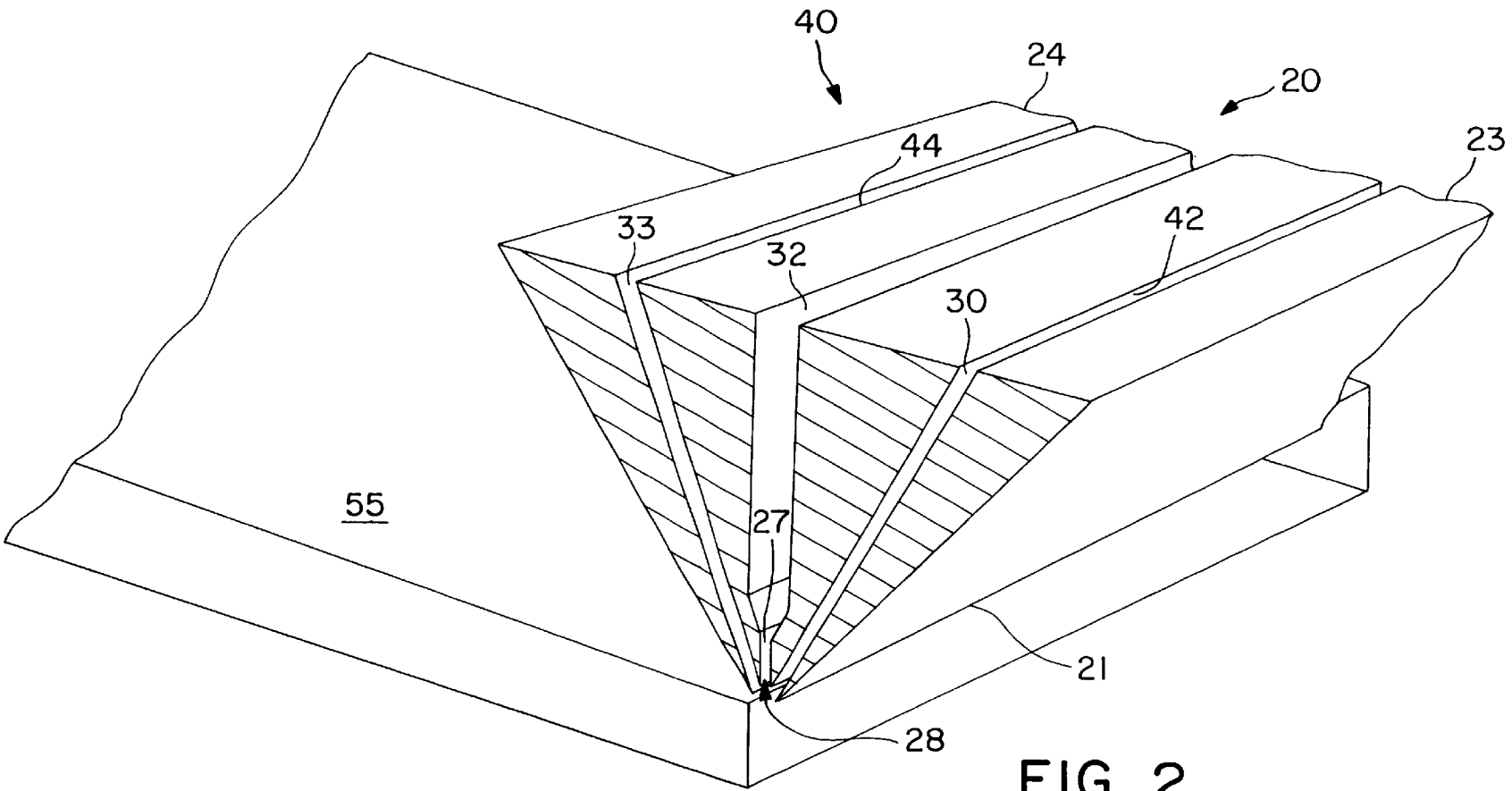
FIG. 2 is a schematic representation of a cross sectional perspective view of the fiber forming portions of a meltblown die in conjunction with a hot air entrainment duct according to an embodiment of the present invention.

An embodiment of the fiber forming portion of the meltblown die to apparatus 14 looking along line 2—2 of FIG. 1 is shown schematically in FIG. 2 and is designated generally by the numeral 20. As shown therein, the fiber forming portion 20 of die apparatus 14 includes a die tip 40 that is connected to the die body (not shown) in a conventional manner. Die tip 40 is formed generally in the shape of a prism (normally an approximate 60° wedge-shaped block) that defines a knife edge 21. Knife edge 21 forms the end of the portion of the die tip 40. Die tip 40 is further defined by a pair of opposed side surfaces 42, 44 that intersect in the embodiment shown in FIG. 2 at the horizontal plane perpendicular to knife edge 21. Knife edge 21 at die tip 40 forms the apex of an angle that ranges from about 30° to 60°.

As shown in FIG. 2, die tip 40 defines a polymer supply passage 32 that terminates in farther passages defined by die tip 40 which are known as capillaries 27. Capillaries 27 are individual passages formed along knife edge 21 and that generally run the length of die tip 40.

Figure 3:
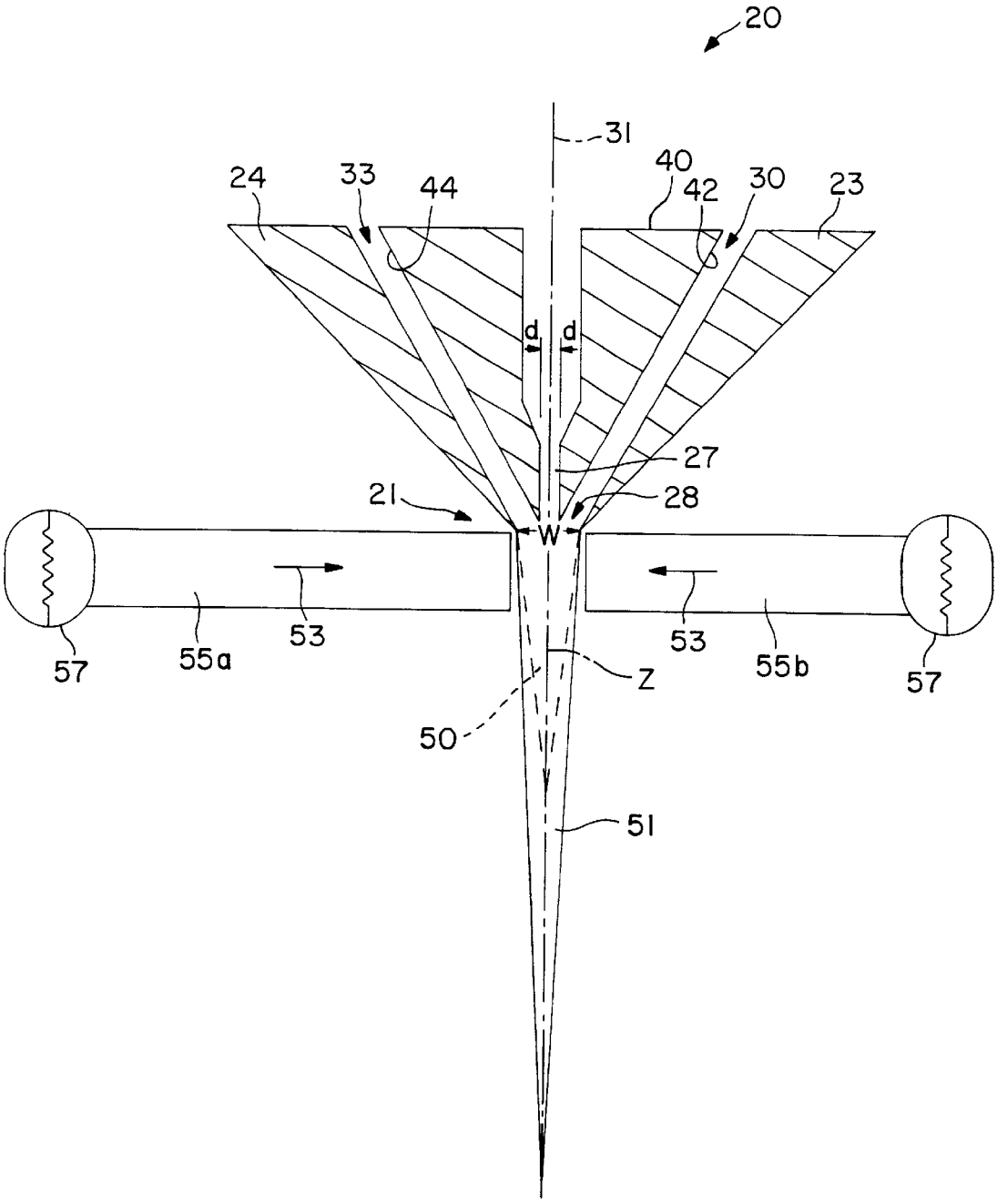
FIG. 3 is a cross sectional elevation similar to FIG. 1 and showing the lengthening effect of the present invention on the jet thermal core.

As shown in FIG. 3, which is an enlarged cross-sectional view of die tip 40, capillaries 27 generally have a diameter that is smaller than the diameter of polymer supply passage 32. Generally, the diameters of all the capillaries 27 will be the same so as to have uniform fiber size formation. The diameter of the capillaries 27 is indicated on FIG. 2 by the double arrows designated "d, d." A typical capillary diameter "d" is 0.0145 inches. Capillaries 27 desirably have a 10/1 length/diameter ratio.

As shown in FIG. 3 for example, capillary 27 is configured to expel liquid polymer, or extrudate, through exit opening 28 as a liquid polymer stream. The liquid polymer stream exits through exit opening 28 in die tip 40 and flows in a direction defining a first axis designated along dotted line 31 in FIG. 3.

As shown in FIGS. 2 and 3, the fiber forming portion 20 of the die apparatus 14 includes a first inner wall 23 and a second inner wall 24 disposed generally opposite first inner wall 23 as the mirror image of first inner wall 23. Inner walls 23 and 24 are also known as "hot air plates" or "hot "plates." Throughout this specification, such walls may be referred to as either inner walls 23 and 24 or hot air plates 23 and 24. Hot air plates 23 and 24 are configured and disposed to cooperate with die tip 40 in order to define a first primary hot air channel 30 and a second primary hot air channel 33. The primary hot air channels 30 and 33 are located with respect to die tip 40 so that primary hot air flowing through the channels will shroud die tip 40 and form a jet thermal core upon exiting the die tip as detailed below. Various arrangements may be utilized to provide the initial runs of both the first and second hot air channels 30 and 33. A secondary hot air duct 55 according to the present invention is provided below knife edge 21.

Referencing FIG. 3, a first jet thermal core 50 of standard proportions is shown as it would be formed in ambient air or with quenching air surrounding the jet. A second jet thermal core 51 according to the present invention has increased length because it has been shrouded at its point of formation immediately below the knife edge 21 by additional thermal energy supplied in the form of secondary hot air flow, indicated by arrows 53, delivered through the secondary hot air ducts 55*a*, 55*b*. One or both sides of the knife edge 21 may be shrouded and supplied with additional hot air flow 53, by e.g., heaters, indicated at 57, as illustrated in FIG. 3. The secondary hot air to be entrained into the jet 51 is preferably substantially over typical ambient temperatures of 80° F., more preferably in the range of 125° F. to 400° F., and most preferably at about 325° F.

In operation, the typical meltblown die head jet thermal core will begin entraining cool or ambient quenching air immediately upon lengthening away from the knife edge, thus reducing its total length. Referencing FIG. 3, according to the present invention, the jet 51 will entrain the secondary hot air 53 at its point of formation at the knife edge thus allowing it to form a longer zone of forceful hot air at temperatures above the melt point of the thermoplastic polymer, leading to increased attenuation or thinning of the polymer exudate and resulting in a thinner fiber. Further, the fibers may, depending on their length of travel, be warmer upon contacting the collecting wire leading to a further changed morphology of the web formed from the individual fibers.

Figure 4:
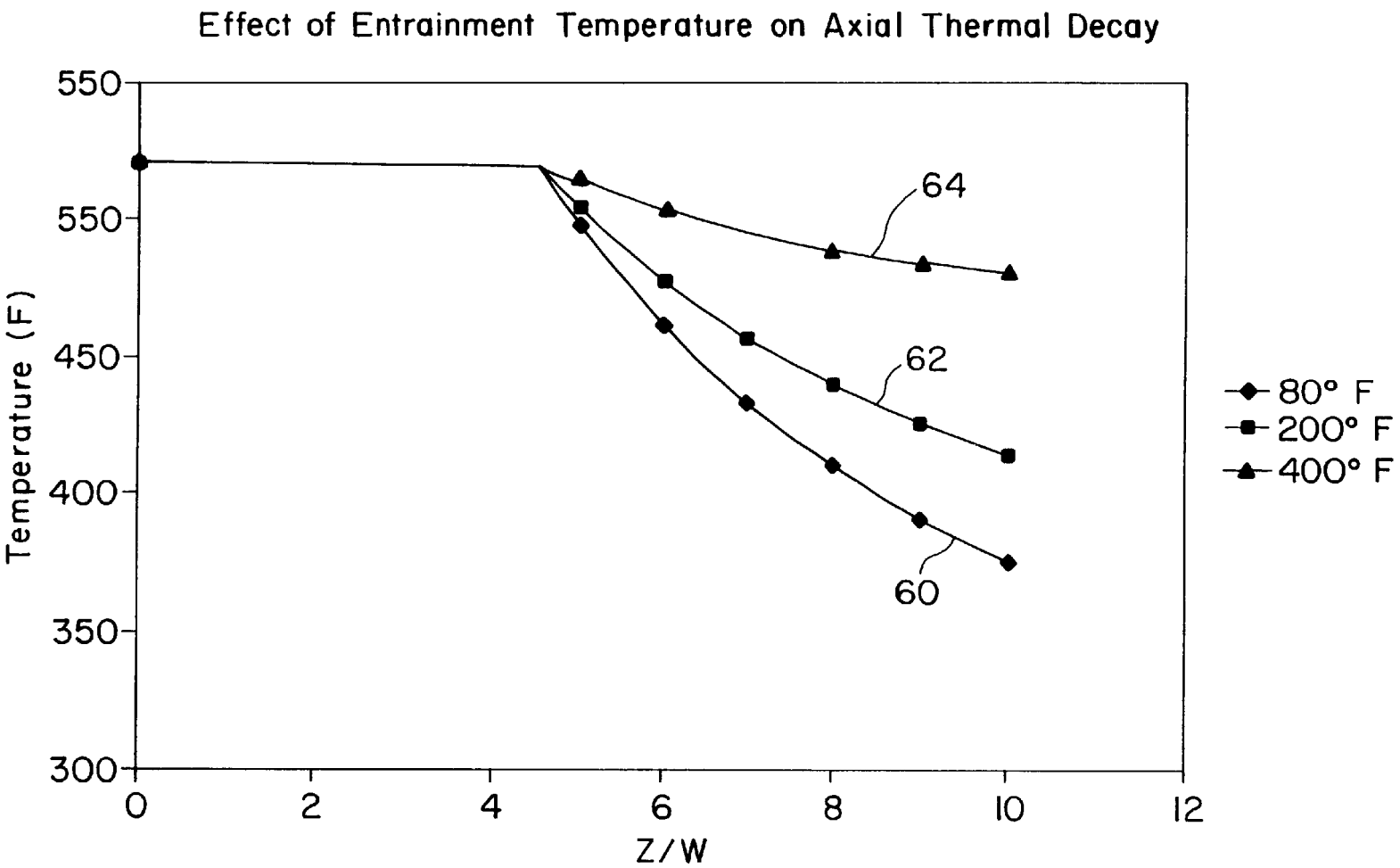
FIG. 4 is a graph of the effect of entrained air temperature on the jet centerline temperature decay illustrating certain principles of the present invention.

Referencing FIGS. 3 and 4, a jet thermal core., e.g., 50, may be seen as having a length from the die head 20 along a longitudinal centerline, Z, and a width, W, at a point perpendicular to Z. At the point of jet formation, W is the distance between plates 23 and 24, and measures 0.90 inches in one embodiment. Temperature at a particular Z/W point is thus an indicator of lengthening for the attenuation zone of the meltspun fibers. Referencing the graph of FIG. 4, at a Z/W point of 10 on the X axis, with a primary air temperature of about 525° F. (Y axis), the temperature of the jet has fallen to about 375° F. for the ambient (80° F.) entrained air indicated at line 60. For 200° F. entrained air, indicated at line 62, the jet temperature is about 420° F. at a Z/W of 10. For 400° F. entrained air, indicated at line 64, the jet temperature is still about 480° at a Z/W of 10. Centerline temperature may be determined by a standard centerline temperature decay model where:

$T=2.12\ (T_o-T_\infty)\ (w/z)^{0.5}+T_\infty$; valid for $z>4.49W$ $T=T_o$ for $Z<4.49$ (Within the jet thermal core, temperature is constant along the centerline for $Z<4.49$ W)

with:

T: Temperature along the jet centerline, z axis;

$T_o$: Temperature at the jet exit, z=0.

$T_\infty$: Temperature of the entrained air or surrounding air;

W: width of the jet at origin, perpendicular to the z-axis (0.090 inches in the Fiber Production Example);

Z: The axial distance from the jet exit along the z-axis

For a polymer such as Exxon Polypropylene 3746G with a melt flow rate of 1500, the attenuation zone, as shown in the below chart, has thus been lengthened by a factor of between eleven and two hundred eight percent, over the known method of having ambient air (80° F.) surrounding the jet thermal core, when using the method of shielding the jet with between 200° F. and 400° F. air to entrain according to the present invention as illustrated by the chart below. The general trends of the below chart and attendant advantages of the present invention, hold true for polymers with melt flow rates down to at least 400.

| $T_\infty$ | z/w | % Increase |
|---|---|---|
| 200 | 6.34 | 11 |
| 250 | 6.82 | 19 |
| 300 | 7.63 | 34 |
| 350 | 9.24 | 62 |
| 400 | 13.86 | 142 |

The length scale z/w corresponds to the position where the temperature is 90% of the initial jet temperature.

The % Increase is the value of z/w evaluated at the 90% jet exit temperature minus z/w for the correlation evaluated at standard ambient conditions for the example (80° F.), which is 5.72. This is then divided by 5.72 and multiplied by 100.

EXAMPLE 1

Fiber Production Example

A polypropylene polymer 3746G available from Exxon Chemical Co., of Baytown, Tex., U.S.A., was put through a standard meltblown die head at the following parameters:

Polymer: Exxon Polypropylene 3746G;

Polymer Throughput: 2 pounds per inch per hour, or per capillary, 0.5 grams per hole per minute;

Basis Weight: 0.5 ounces per square yard;

Hot Air Flow (secondary air introduced into the jet): 500 to 1000 feet per minute;

Hot Air Temperature: 200 to 300 degrees Fahrenheit;

Polymer Temperature: 520 degrees Fahrenheit;

Primary Air Temperature: 540 degrees Fahrenheit;

Primary Air Pressure: 6 psi
Results:

| Hot Air Temperature (° F.) | Hot Air Flow (ft/min) | Fiber Size (microns) | Hydrohead (mbars) | Air Permeability |
|---|---|---|---|---|
| 200 | 500 | 1.98 | 112 | 25 |
| 200 | 1000 | 1.83 | 134 | 20 |
| 300 | 500 | 1.32 | 139 | 20 |
| Control | — | 3.34 | 96 | 40 |

Fiber size was determined with SEMs and Image Analysis as set forth below. Hydrohead was measured as set forth below.

The present invention has been found to provide a substantial increase in meltblown fabric barrier properties. Hydrohead values increased by 28% and air permeability decreased by 44%. Gains in isopropyl alcohol repellency of 36% were also found due to blooming out of internal additives in certain polymer compositions under the increased heat entrainment of the present invention.

It is known that in the making of some meltspun fibers, surfactants and other active agents have been included in the polymer that is to be melt-processed. By way of example only, U.S. Pat. Nos. 3,973,068 and 4,070,218 to Weber teach a method of mixing a surfactant with the polymer and then melt-processing the mixture to form the desired fabric. The fabric is then treated in order to force the surfactant to the surface of the fibers. This is often done by heating the web on a series of heated rolls and is often referred to as "blooming." As a further example, U.S. Pat. No. 4,578,414 to Sawyer et al. describes wettable olefin polymer fibers formed from a composition comprising a polyolefin and one or more surface-active agents. The surface-active agents are stated to bloom to the fiber surfaces where at least one of the surface-active agents remains partially embedded in the polymer matrix. In this regard, the permanence of wettability can be better controlled through the composition and concentration of the additive package. Still further, U.S. Pat. No. 4,923,914 to Nohr et al. teaches a surface-segregatable, melt-extrudable thermoplastic composition suitable for processing by melt extrusion to form a fiber or film having a differential, increasing concentration of an additive from the center of the fiber or film to the surface thereof. The differential, increasing concentration imparts the desired characteristic, e.g. hydrophilicity, to the surface of the fiber. As a particular example in Nohr, polyolefin fiber nonwoven webs are provided having improved wettability utilizing various polysiloxanes.

In a further advantage of the present invention, it has been found that use of the present invention can provide a means for blooming the additives without the additional roller treatments described above. For example one polymer composition, having fluorochemicals, as may be used to aid in repellency of low surface tension fluids, was treated according to the present invention and showed a 36% increase in isopropyl alcohol repellency as compared to the control polymer run without additional heat entrainment to increase jet thermal core length.

Of course, the particular active agent or agents included within one or more of the components can be selected as desired to impart or improve specific surface characteristics of the fiber and thereby modify the properties of the fabric made therefrom. A variety of active agents or chemical compounds have heretofore been utilized to impart or improve various surface properties including, but not limited to, absorbency, wettability, anti-static properties, anti-microbial properties, anti-fungal properties, liquid repellency (e.g. alcohol or water) and so forth. With regard to the wettability or absorbency of a particular fabric, many fabrics inherently exhibit good affinity or absorption characteristics for only specific liquids. For example, polyolefin nonwoven webs have heretofore been used to absorb oil or hydrocarbon based liquids. In this regard, polyolefin nonwoven wipes are inherently oleophillic and hydrophobic. Thus, polyolefin nonwoven fabrics need to be treated in some manner in order to impart good wetting characteristics or absorbency for water or aqueous solutions or emulsions. As an example, exemplary wetting agents that can be melt-processed in order to impart improved wettability to the fiber include, but are not limited to, ethoxylated silicone surfactants, ethoxylated hydrocarbon surfactants, ethoxylated fluorocarbon surfactants and so forth. In addition, exemplary chemistries useful in making melt-processed thermoplastic fibers more hydrophilic are described in U.S. Pat. Nos. 3,973,068 and 4,070,218 to Weber et al., and U.S. Pat. No. 5,696,191 to Nohr et al.; the entire contents of the aforesaid references are incorporated herein by reference.

In a further aspect, it is often desirable to increase the barrier properties or repellency characteristics of a fabric for a particular liquid. As a specific example, it is often desirable in infection control products and medical apparel to provide a fabric that has good barrier or repellency properties for both water and alcohol. In this regard, the ability of thermoplastic fibers to better repel alcohol can be imparted by mixing a chemical composition having the desired repellency characteristics with the thermoplastic polymer resin prior to extrusion and thereafter melt-processing the mixture into one or more of the segments. The active agent migrates to the surface of the polymeric component thereby modifying the surface properties of the same. In addition, it is believed that the distance or gap between components exposed on the outer surface of the fiber containing significant levels of active agent is sufficiently small to allow the active agent to, in effect, modify the functional properties of the entire fiber and thereby obtain a fabric having the desired properties. Chemical compositions suitable for use in melt-extrusion processes and that improve alcohol repellency include, but are not limited to, fluorochemicals. Exemplary melt-processable liquid repellency agents include those available from DuPont under the trade name ZONYL fluorochemicals and also those available from 3M under the trade designation FX-1801. Various active agents suitable for imparting alcohol repellency to thermoplastic fibers are described in U.S. Pat. No. 5,145,727 to Potts et al., U.S. Pat. No. 4,855,360 to Duchesne et al., U.S. Pat. No. 4,863,983 to Johnson et al., U.S. Pat. No. 5,798,402 to Fitzgerald et al., U.S. Pat. No. 5,459,188 and U.S. Pat. No. 5,025,052; the entire contents of the aforesaid references are incorporated herein by reference. In addition to alcohol repellency, chemical compositions can be used to similarly improve the repellency or barrier properties for other low surface tension liquids. By use of the present invention, many of the above discussed advantageous properties may be had during the formation of the fibers.

Test Procedures

Hydrostatic Pressure Test Procedure

In this test, water pressure is measured to determine how much water pressure is required to induce leakage in three separate areas of a test material. The water pressure is reported in millibars (mbars) at the first sign of leakage in three separate areas of the test specimen. The pressure in millibars can be converted to hydrostatic head height in inches of water by multiplying millibars by 0.402. Pressure measured in terms of inches refers to pressure exerted by a number of inches of water. Hydrostatic pressure is pressure exerted by water at rest.

Apparatus used to carry out the procedure includes a hydrostatic head tester, such as TEXTEST FX-3000 available from ATI Advanced Testing Instruments Corp. of Spartenburg, S.C., a 25.7 $cm^2$ test head such as part number FX3000-26 also available from ATI Advanced Testing Instruments Corp., purified water such as distilled, deionized, or purified by reverse osmosis, a stopwatch accurate to 0.1 second, a one-inch circular level, and a cutting device, such as scissors, a paper cutter, or a die-cutter.

Prior to carrying out this procedure, any calibration routines recommended by manufacturers of the apparatus being used should be performed. Using the cutting device, the specimen is cut to the appropriate size. Each specimen has a minimum size that is sufficient to allow material to extend beyond the outer diameter of the test head. For example, the 25.7 $cm^2$ test head requires a 6-inch by 6-inch, or 6-inch diameter specimen. Specimens should be free of unusual holes, tears, folds, wrinkles, or other distortions.

First, make sure the hydrostatic head tester is level. Close the drain faucet at the front of the instrument and pull the upper test head clamp to the left side of the instrument. Pour approximately 0.5 liter of purified water into the test head until the head is filled to the rim. Push the upper test head clamp back onto the dovetail and make sure the plug is inserted into the socket at the left side of the instrument. Turn the instrument on and allow the sensor to stabilize for 15 minutes. Make sure the Pressure Gradient thumbwheel switch is set to 60 mbar/min. Make sure the drain faucet is closed. The water temperature should be maintained at about 75° Fahrenheit±10° Fahrenheit. Use the Light Intensity adjustment to set the test head illumination for best visibility of water droplets passing through the specimen.

Once the set-up is complete, slide the specimen onto the surface of the water in the test head, from the front side of the tester. Make sure there are no air bubbles under the specimen and that the specimen extends beyond the outer diameter of the test head on all sides. If the upper test head clamp was removed for loading the specimen, push the clamp back onto the dovetail. Pull down the lever to clamp the specimen to the test head and push the lever until it comes to a stop. Press the Reset button to reset the pressure sensor to ZERO. Press the Start/Pause button to start the test. Observe the specimen surface and watch for water passing through the specimen. When water droplets form in three separate areas of the specimen, the test is complete. Any drops that form within approximately 0.13 inch (3.25 mm) of the edge of the clamp should be ignored. If numerous drops or a leak forms at the edge of the clamp, repeat the test with another specimen. Once the test is complete, read the water pressure from the display and record. Press the Reset button to release the pressure from the specimen for removal. Repeat procedure for desired number of specimen repeats.

Air Permeability

This test determines the airflow rate through a sample for a set area size and pressure. The higher the airflow rate per a given area and pressure, the more open the fabric is, thus allowing more fluid to pass through the fabric. Air permeability is determined using a pressure of 125 Pa (0.5 inch water column) and is reported in cubic feet per minute per square foot. The air permeability data reported herein can be obtained using a TEXTEST FX 3300 air permeability tester.

Fiber Diameter Test Procedures

Fiber diameters were tested using a Scanning Electron Microscope (SEM) Image Analysis of Meltblown Fiber Diameter test. The meltblown web was tested for Count-Based Mean Diameter and Volume-Based Mean Diameter.

Count-Based Mean Diameter

The count-based mean diameter is the average fiber diameter based on all fiber diameter measurements taken. For each test sample, 300 to 500 fiber diameter measurements were taken.

Volume-Based Mean Diameter

The volume-based mean diameter is also an average fiber diameter based on all fiber diameter measurements taken. However, the volume-based mean diameter is based on the volume of the fibers measured. The volume is calculated for each test sample and is based on a cylindrical model using the following equation:

$$V=\pi A^2/2P;$$

where A is the cross-sectional area of the test sample and P is the perimeter of the test sample. Fibers with a larger volume will carry a heavier weighting toward the overall average. For each test sample, 300 to 500 measurements were taken.

While in the foregoing specification means and method for attaining a meltblown web of fine fiber size and excellent liquid/fluid barrier properties has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method of increasing a meltblown jet thermal core length issuing from a melt blown die, comprising:

adding heat energy to the jet thermal core during initial formation of the jet thermal core to shroud the jet thermal core from ambient air thereby increasing the jet thermal core length and attenuation time of the meltblown fibers.

2. The method of increasing a meltblown jet thermal core length issuing from a melt blown die according to claim 1, further comprising:

entraining hot air during initial formation of the jet thermal core of between 100° F. and 400° F. at an air flow rate of at least about 500 feet/minute from a source below the meltblown die knife edge towards the area occupied by the meltblown jet thermal core.

3. The method of increasing a meltblown jet thermal core length issuing from a melt blown die according to claim 2, further comprising:

entraining hot air during initial formation of the jet thermal core of at least 300° F. from a source below the meltblown die knife edge towards the area occupied by the meltblown jet thermal core.

4. A method of producing a meltblown nonwoven web comprising:

extruding a thermoplastic polymer in its liquid state into a meltblown jet thermal core;

creating a zone of hot air around the meltblown jet thermal core to enable the jet thermal core to lengthen thereby increasing fiber formation dwell time within the jet thermal core at temperatures above the extrudate melting point and extending an attenuation time of fiber formation resulting in fine meltblown filaments; and collecting the filaments on a collection surface to form a nonwoven web.

5. The method of producing a meltblown nonwoven web according to claim 4 further comprising entraining air in a range of about 100° F. to 400° F. from a source below the meltblown die knife edge towards the area occupied by the meltblown jet thermal core.

6. The method of producing a meltblown nonwoven web according to claim 4 further comprising entraining air in a range of about 200° F. to about 400° F. at a rate of between about 500 and 1000 feet/minute from a source below the meltblown die knife edge towards the formation area of the meltblown jet thermal core.

7. The method of producing a meltblown nonwoven web according to claim 4, further comprising:

lengthening the jet thermal core length to a distance increase of between 11% and 142% with a centerline temperature of at least 90% of the jet thermal core formation temperature.

8. The method of producing a meltblown nonwoven web according to claim 4 further comprising selecting the polymer to have a melt flow range between 400 and 1500 grams/10 minutes.

9. The method of producing a meltblown nonwoven web according to claim 4 further comprising using a low viscosity polymer having a melt flow rate at or below 1500 grams/10 minutes.

10. The method of producing a meltblown nonwoven web according to claim 4 further comprising using a low viscosity polymer having a melt flow rate at or below 400 grams/10 minutes.

11. The method of producing a meltblown nonwoven web according to claim 4 further comprising selecting the fibers to be comprised of polypropylene polymer.

12. The method of producing a meltblown nonwoven web according to claim 4 further comprising producing fibers of less than 2 microns diameter to form the web.

13. The method of producing a meltblown nonwoven web according to claim 9 wherein the web has an air permeability at or below 70 SCFM per square foot.

14. The method of producing a meltblown nonwoven web according to claim 10 wherein the web has an air permeability at or below 70 SCFM per square foot.

15. The method of producing a meltblown nonwoven web according to claim 9 wherein the web has a "basis weight" of 0.5 osy and an air permeability rate of below 125 SCFM/square foot.

16. The method of producing a meltblown nonwoven web according to claim 10 wherein the web has a "basis weight" of 0.5 osy and an air permeability rate of below 125 SCFM/square foot.

17. The method of producing a meltblown nonwoven web according to claim 9 wherein the web has a "basis weight" of 0.5 osy and a hydrohead of at least 112 mbars.

18. The method of producing a meltblown nonwoven web according to claim 10 wherein the web has a "basis weight" of 0.5 osy and a hydrohead of at least 112 mbars.

19. The method of producing a meltblown nonwoven web according to claim 9 wherein the web has a "basis weight" of 0.5 osy and a hydrohead of between 112 and 139 mbars.

20. The method of producing a meltblown nonwoven web according to claim 10 wherein the web has a "basis weight" of 0.5 osy and a hydrohead of between 112 and 139 mbars.

21. The method of producing a meltblown nonwoven web according to claim 4 wherein the jet core is lengthened to bloom polymer additives to the surface of the fiber.

* * * * *